US007234603B1

(12) United States Patent
Harris et al.

(10) Patent No.: US 7,234,603 B1
(45) Date of Patent: Jun. 26, 2007

(54) SWING-ARM RACK WITH DROP-ARM LOCKING MECHANISM

(76) Inventors: Nina L. Harris, P.O. Box 35, Madison Heights, VA (US) 24572; James R. Harris, P.O. Box 35, Madison Heights, VA (US) 24572

( * ) Notice: Subject to any disclaimer, the term of this patent is extended or adjusted under 35 U.S.C. 154(b) by 109 days.

(21) Appl. No.: 11/156,923

(22) Filed: Jun. 20, 2005

(51) Int. Cl.
*A47H 1/00* (2006.01)

(52) U.S. Cl. ..... 211/100; 211/171; 211/197

(58) Field of Classification Search ..... 211/100, 211/197, 169, 85.24, 99, 171, 94.03, 119.01, 211/180, 90.02, 149, 195, 193, 90.01, 104, 211/87.01, 96, 118, 119.004; 248/240, 241, 248/235; 108/42
See application file for complete search history.

(56) References Cited

U.S. PATENT DOCUMENTS

| | | | | | |
|---|---|---|---|---|---|
| 801,185 | A | * | 10/1905 | Degner | 160/336 |
| 1,471,328 | A | * | 10/1923 | De Grasse | 211/99 |
| 1,529,053 | A | * | 3/1925 | Bried | 211/99 |
| 1,551,468 | A | * | 8/1925 | Chapman | 211/99 |
| 1,675,922 | A | | 7/1928 | Burt | |
| 1,717,981 | A | | 6/1929 | Kirshner | |
| 1,767,545 | A | | 6/1930 | Mossbacher | |
| 2,067,833 | A | * | 1/1937 | Edison | 211/89.01 |
| 2,158,616 | A | | 5/1939 | Blameuser | |
| 2,217,795 | A | | 10/1940 | Dawson | |
| D152,591 | S | | 2/1949 | Canner | |
| 2,471,349 | A | | 5/1949 | Reiss | |
| 2,476,091 | A | | 7/1949 | Herschkowitz | |
| 2,562,093 | A | | 7/1951 | Heisler | |
| 2,562,622 | A | | 7/1951 | Laughlin | |
| 2,583,571 | A | * | 1/1952 | Howe | 172/36 |
| 2,615,579 | A | | 10/1952 | Sampson | |
| 2,662,645 | A | * | 12/1953 | Piton | 108/135 |
| 2,875,903 | A | * | 3/1959 | Shourds | 211/100 |
| 2,948,406 | A | * | 8/1960 | Steele | 211/99 |
| 3,194,406 | A | | 7/1965 | Simetl | |
| 3,211,295 | A | * | 10/1965 | Weiss | 211/100 |
| 4,171,748 | A | * | 10/1979 | Fabian | 211/1.3 |
| 4,611,721 | A | | 9/1986 | Heckaman | |
| 5,019,126 | A | * | 5/1991 | Post | 211/104 |
| D321,094 | S | | 10/1991 | Greenhut | |
| D324,784 | S | | 3/1992 | Rose | |
| 5,178,287 | A | | 1/1993 | Klein | |
| D333,731 | S | | 3/1993 | Klein | |

* cited by examiner

*Primary Examiner*—Jennifer E. Novosad
(74) *Attorney, Agent, or Firm*—Denis R. O'Brien

(57) ABSTRACT

A swing-arm rack for storing and/or displaying hanging articles, the rack comprises a swing-arm that is pivotally attached by its upper terminus to a vertical support such that the swing-arm hangs substantially vertically in a folded configuration. The fixed terminus of a drop arm is pivotally attached to the lower end of the swing-arm. A flexible restraint is connected to the free end of the drop-arm. The opposing end of the flexible restraint passes through an aperture in the swing-arm and is secured against the outward surface of the swing-arm by a keeper. In a deployed configuration of the swing-arm rack, the drop arm is oriented substantially horizontally with its free end abutting the vertical support, thereby locking the bottom of the swing-arm away from the vertical support so that the hanging articles are more easily accessed. In a folded configuration of the swing-arm rack, the free end of the drop-arm is juxtaposed against the inward surface of the upper end of the swing-arm.

9 Claims, 3 Drawing Sheets

SWING-ARM RACK WITH DROP-ARM LOCKING MECHANISM

BACKGROUND OF THE INVENTION

1. Field of the Invention

The field of this invention is swing-arm racks for storing and/or displaying clothes, jewelry, accessories, ties, linen, and other articles that are amenable to being hung from a rack.

2. Scope and Usage of Certain Terms

The following lexicon sets forth the intended scope and meaning of certain terms and concepts used herein. The definitions set forth here include the plural and grammatical variations of the terms defined. Examples used in the definitions are intended to illustrate and clarify, and not to limit, the definitions. Unless otherwise noted, meanings of terms not included in this lexicon are to be determined by reference to the American Heritage Dictionary of the English Language, Third Edition, Houghton Mifflin Co., 1973.

Swing-arm rack—a rack of the type in which the upper terminus of an elongate swing-arm is pivotally fixed to a support so that the lower end of the swing-arm is free to swing up and down in an arc.

Upper end and lower end—with respect to an elongate swing-arm of the type having an upper terminus and an opposing lower terminus, as disclosed below, "upper end" refers to the portion of the swing-arm from approximately its midpoint to and including its upper terminus, and "lower end" refers to the portion of the swing-arm from approximately its midpoint to and including its lower terminus.

Free end and fixed end—with respect to an elongate drop-arm of the type having a free terminus and an opposing fixed terminus, as disclosed below, "free end" refers to the portion of the drop-arm from approximately its midpoint to and including its free terminus and "fixed end" refers to the portion of the drop-arm from its midpoint to and including its fixed terminus.

Inward surface and outward surface—with respect to an elongate swing-arm as described below, the inward surface of the swing-arm is the surface facing the vertical support to which the swing-arm is connected. The outward surface of the swing-arm is the surface facing away from the vertical support.

Hanging articles—items that are amenable to being stored and/or displayed by being hung from a swing-arm rack. By way of illustration, such hanging articles include scarves, ties, clothing, accessories, jewelry, towels, linens, cooking implements, and tools.

Lateral projection—the element of a swing-arm rack projecting laterally from the swing-arm for the purpose of receiving and holding one or more hanging articles. Such lateral projections may take the form of, by way of example, rods, hooks, dogs, pegs, or fingers.

RELATED ART AND STATEMENT OF THE PROBLEMS SOLVED BY THE INVENTION

Numerous types of swing-arm racks for storing/displaying hanging articles are described in the literature. The swing-arm rack design is popular and useful because the swing-arm can be swung upward to a horizontal or near-horizontal position in order to more easily access the hanging articles. The rack is folded into a compact vertical configuration when not in use, thus conserving space. Representative examples of such swing-arm racks are provided by U.S. Pat. No. 2,615,579 to Sampson, U.S. Pat. No. 4,611,721 to Heckaman, U.S. Pat. No. 5,178,287 to Klien et al., and U.S. Pat. No. 1,717,981 to Kirshner.

While all swing-arm racks achieve the objective of conserving space, the hinge mechanisms or brackets employed at the upper end of the swing-arm to permit the lower end of the swing-arm to swing to and fro and yet hold the rack fixed firmly in its deployed configuration are generally complex in their structure and cumbrous in their function. This complexity results in increased production costs and an increased susceptibility to malfunctions. The present invention represents an elegant solution to these shortcomings of existing swing-arm racks by providing a novel swing-arm rack that is inexpensive to construct, simple to use, and virtually free of potential for malfunction.

BRIEF SUMMARY OF THE INVENTION

The present invention is a swing-arm rack that is reversibly convertible between a folded configuration and a deployed configuration, the rack being employed for storing and/or displaying hanging articles. The invention comprises an elongate swing-arm from which extends one or more lateral projections for holding the hanging articles. The elongate swing-arm has an inner surface facing a vertical support, such as a door, wall, cabinet, stud, or post, and an outward surface facing away from the vertical support. The upper terminus of the swing-arm is pivotally connected to the vertical support. This connection is achieved by a hinge means that allows the lower, free end of the swing-arm to swing away from the vertical support in an arc. The fixed terminus of an elongate drop-arm is connected to the inward surface of the swing-arm. This connection is most conveniently achieved by means of a second, or lower, hinge. In the folded configuration, the drop-arm and swing-arm hang in a substantially vertical orientation supported by the upper hinge, the drop-arm positioned between the inward surface of the swing-arm and the vertical support with the free end of the drop-arm juxtaposed against the upper end of the swing-arm. As the lower end of the swing-arm is swung away from the vertical support, gravitational forces urge the free end of the drop-arm to fall downward until the downward movement of the free end of the drop-arm is arrested by the action of a flexible restraint, such as a cord. One end of the cord is attached to the free end of the drop-arm; the other end of the cord passes from the inward surface of the swing-arm through an aperture in the swing-arm and is secured adjacent the outward surface of the swing-arm by a keeper such as a stop, gland, cleat, or knot, which keeper constrains the free end of the cord from passing back through the aperture.

When the rack is fully extended in the deployed configuration, the flexible restraint holds the drop-arm with the free end of the drop-arm abutting the vertical support, thereby locking the bottom end of the swing-arm away from the vertical support and transmitting to the vertical support the gravitational force acting upon the swing-arm and the hanging articles supported thereby. Consequently, while the rack is in its deployed configuration, the drop-arm is locked in position holding the bottom end of the swing arm away from the vertical support at an angle that permits ease of access to the items hanging on the lateral projections. The rack is converted back to the folded configuration by using the flexible restraint to urge the free end of the drop-arm upwards into a substantially vertical orientation until it is juxtaposed against the upper end of the swing-arm.

BRIEF DESCRIPTION OF THE DRAWINGS

In the drawings identical reference numbers are employed to identify identical elements. The sizes and relative positions of the elements in the drawings are not necessarily drawn to scale. For example, thicknesses are not drawn to scale and are in many cases enlarged to insure comprehension of the drawings.

DETAILED DESCRIPTION OF THE INVENTION

Structural Features

Figure 1:
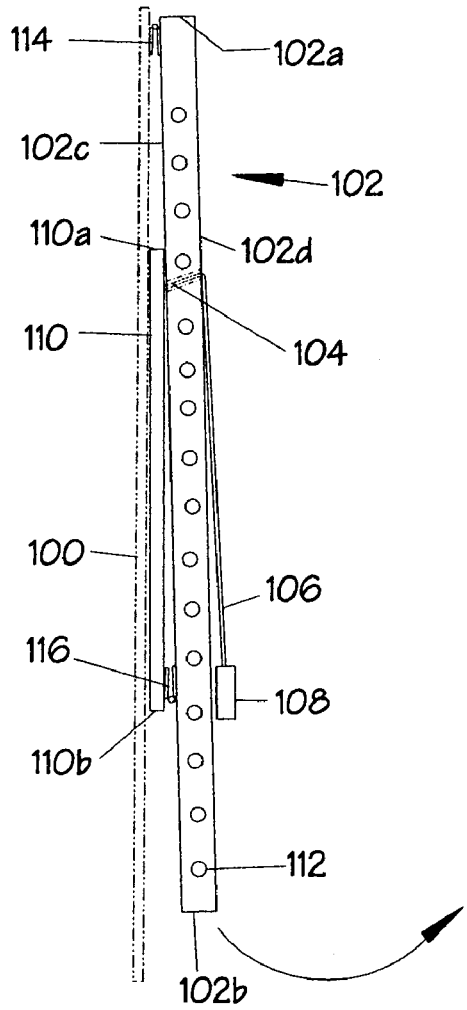
FIG. 1 is a side elevation of a preferred embodiment of the invention wherein the invention is in its folded state.
Figure 2:
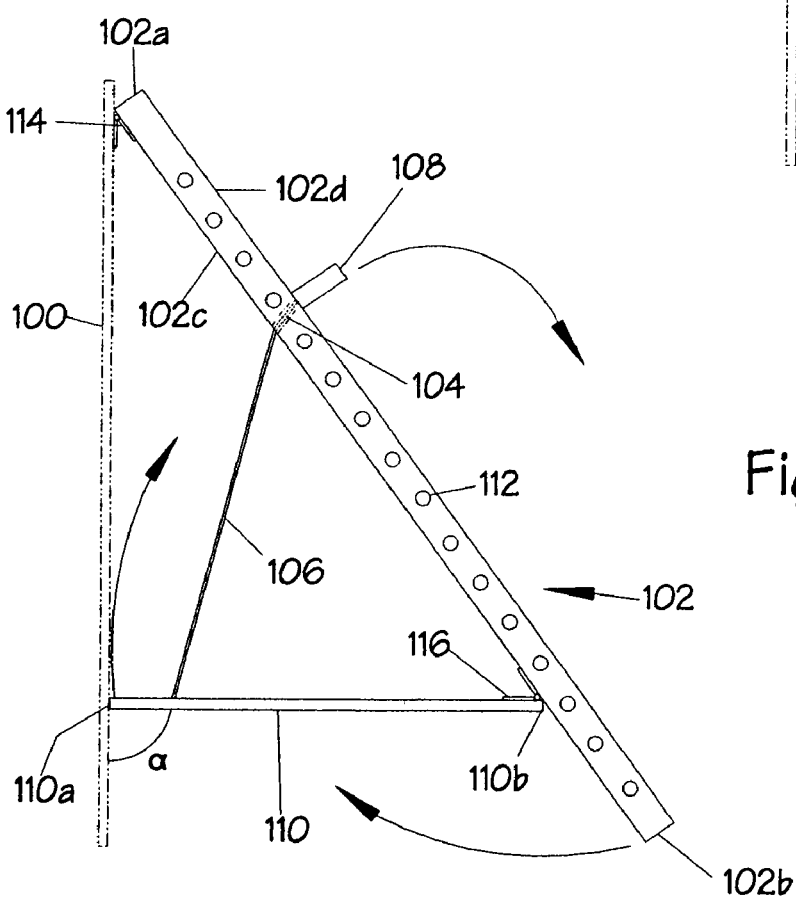
FIG. 2 is a side elevation of the preferred embodiment of the invention wherein the invention is in its deployed state.

The preferred embodiment in its folded configuration is shown in FIG. 1, and the deployed configuration is shown in FIG. 2.

Swing-arm 102 has an upper terminus 102*a* that delimits the upper end of the swing-arm, a lower terminus 102*b* that delimits the lower end of the swing-arm, an inward surface 102*c* facing a vertical support 100, and an outward surface 102*d* facing away from the vertical support. Upper swing-arm terminus 102*a* is attached to the vertical support by means of upper hinge 114 such that the swing-arm hangs essentially vertically from the vertical support when in the folded configuration.

Drop-arm 110 has a free terminus 110*a* delimiting the free end of the drop-arm, and a fixed terminus 110*b* delimiting the fixed end of the drop-arm. The drop-arm is pivotally connected by its fixed terminus to swing-arm 102 by means of lower hinge 116. The length of the drop-arm and the point of attachment of the fixed end along the length of the swing-arm are major determinants of how far from the vertical support the swing-arm will extend from the vertical support when in the deployed configuration. These determinants can be easily adjusted to meet the needs of the user or market without undue experimentation. We have found that attaching the fixed terminus of the drop-arm approximately half-way between the midpoint and lower terminus of the swing-arm gives satisfactory results.

Cord 106 is employed as a flexible restraint for restraining the free end 110*a* of drop-arm 110 from falling too far when in the deployed configuration. A first end of cord 106 is attached to the free end of drop-arm 110. A second end of cord 106 passes through an aperture 104 in the swing-arm 102, from the inward surface 102*c* of the swing-arm to the outward surface 102*d*, where it is secured by stop 108, which acts as a keeper to prevent the end of the cord from passing back through the aperture. A plurality of spaced-apart lateral projections 112 for receiving hanging articles project laterally from swing-arm 102.

The flexible restraint is used to urge the free end of the drop-arm upwards to bring the invention into its folded configuration (FIG. 1), in which free end 110*a* of the drop-arm is juxtaposed against the inward surface of the upper end of the swing-arm 102. In the deployed configuration, FIG. 2, the free terminus of the drop-arm abuts vertical support 100.

Figure 3:
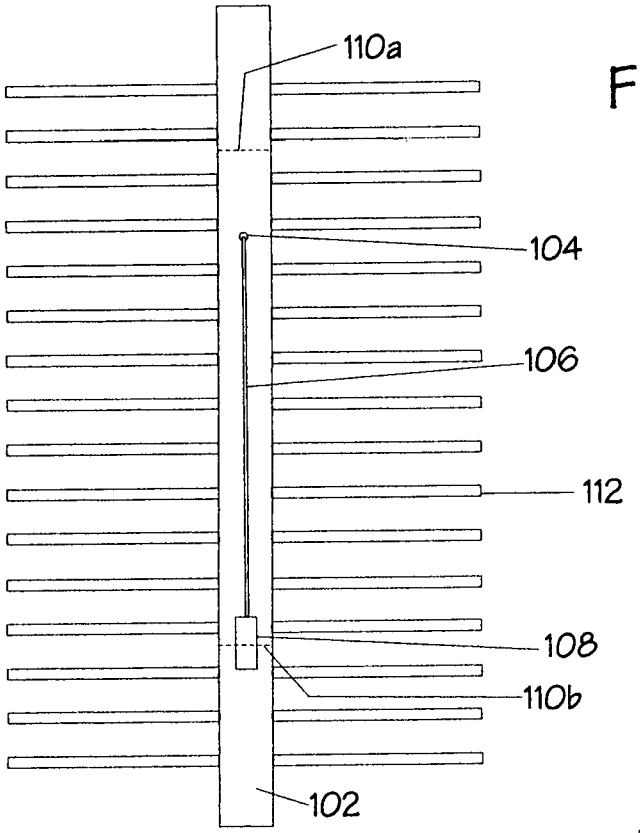
FIG. 3 is a front elevation of the preferred embodiment of the invention wherein the invention is in its folded state.
Figure 4:
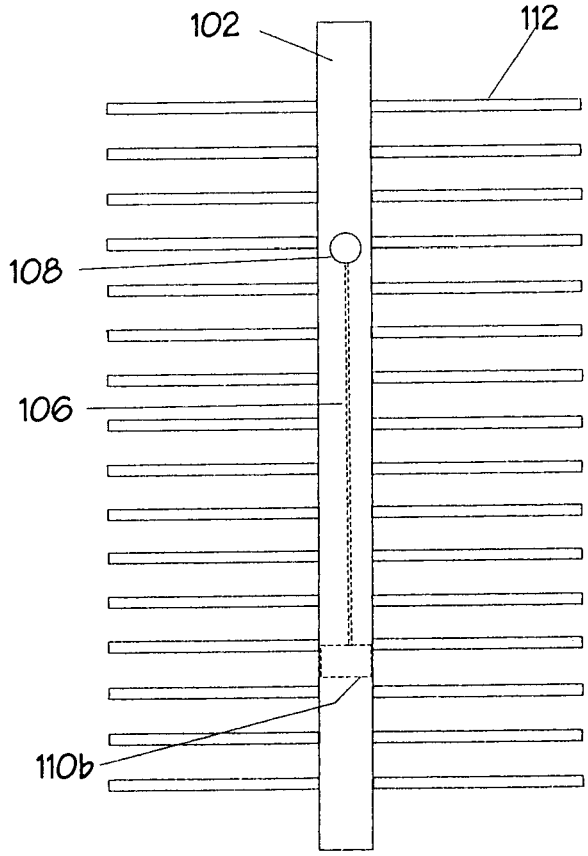
FIG. 4 is a front elevation of the preferred embodiment of the invention wherein the invention is in its deployed state.

FIG. 3 shows a front view of the invention in its folded configuration. It will be noted that in this configuration, most of the length of cord 106 extends through aperture 104 such that stop 108 hangs down the front of swing-arm 102. FIG. 4 shows a front view of the invention in its extended configuration. In this configuration stop 108 abuts aperture 104 (not visible) on the outward surface of the swing-arm and constrains the end of cord 106 from passing through the aperture. Thus, cord 106 stretches downward from aperture 104 and supports the free end of drop-arm 110. Spaced-apart lateral projections 112 are provided for receiving hanging articles.

From these figures it will be obvious to one skilled in the art how to easily and economically construct our invention using a variety of materials. For instance, the invention can be easily and inexpensively constructed in wood or molded plastic by employing techniques well known in these fields.

Functional Features

The functional features and advantages of our invention are easily comprehended by comparing FIGS. 1 and 2. First, it will be readily apparent that in the folded configuration shown in FIG. 1, the rack lies nearly flat against vertical support 100. This is a common and desirable attribute of this type of rack. In our invention, the distance the folded rack extends from vertical support 100 is approximately the sum of the thicknesses of drop-arm 110 and swing-arm 102.

To deploy the invention, one grasps swing-arm terminus 102*b* and pulls the bottom of the swing-arm upward in an arc away from vertical support 100. As the bottom of the swing-arm moves away from the vertical support, the free terminus 110*a* of drop-arm 110 falls under the influence of gravity. Because cord 106 is attached to the free end of the drop-arm, the weight of the drop-arm 11 pulls the cord through the aperture 104, causing stop 108 to rise until it abuts the aperture, thereby preventing the cord and the drop-arm from moving any further. As shown in FIG. 2, by judiciously choosing the lengths of cord 106 and drop-arm 110, the drop-arm will be substantially horizontal when the stop comes to rest against the aperture—in other words, angle $\alpha$ is approximately 90°. In this configuration, gravitational forces acting upon the swing-arm and hanging articles are conveyed to the vertical support through the drop-arm. Articles hung on lateral projections 112 remain oriented vertically when the rack is deployed, and therefore they are easily accessed by the user. It will be recognized that the rack when so deployed is very stable and will remain in the deployed configuration indefinitely without user assistance. The user may remove, add, or adjust the hanging items by using both hands, since one hand is not required to support the rack in its deployed position as is the case of swing-arm racks of the kind disclosed in U.S. Pat. No. 2,158,616 to Blameuser.

In order to close our invention into its folded configuration, one lifts bottom terminus 102*b* of swing-arm 102 slightly while pulling stop 108, thereby using the flexible restraint to urge free end 110*a* upwards until the drop-arm is in a substantially vertical orientation. Swing-arm 102 then hangs nearly straight down from upper hinge 114 with the drop-arm oriented vertically between the inward surface for the swing-arm and the vertical support.

Details, Embellishments, and Variations

Unilateral Configuration

It will be appreciated that our invention can be adapted for use in tight spaces or corners by providing lateral projections 112 on one side only of swing-arm 102. Thus, referring to FIG. 3, if the lateral projections on the right side of the invention are removed, the invention can be mounted in a corner within an inch or two of a wall to the right of the invention that forms a corner with the vertical support. Such a unilateral configuration can be a obtained at the time of manufacture or may be an option that the user exercises by having the lateral projections easily removable, for instance by means of threaded attachments of the lateral projections to the swing-arm.

Dimensions and Scale

The inventive concept of our invention is not restricted to any specific scale. It is as amenable to a small scale applications in which the length of the swing-arm is a few centimeters, as it is to a larger scale applications in which the length of the swing-arm is a meter or more. Small scale applications include using the invention to store and display jewelry, or small instruments and tools. Larger scale applications include using the invention to store or display linen, or bedding, or garden tools. This potential variability of scale combined with the ability to assume a unilateral configuration insures that the potential applications of our invention are greatly multiplied. It can be employed inside chests, closets, wardrobes, or cabinets. It can be mounted adjacent to the corners of rooms, closets, or chests.

Door-Mountable Hinge

When doors are used as the vertical supports, our invention can be conveniently mounted on the outside, the inside, or both sides of the door simultaneously. For instance, when attached to a closet or wardrobe door, our invention may be mounted so that it faces either toward the inside or toward the outside of the closet or wardrobe, depending on the needs of the user. Such door-mounted applications of our invention can be conveniently effectuated by means of an upper hinge optionally adapted to engage the top edge of the door.

Figure 5:
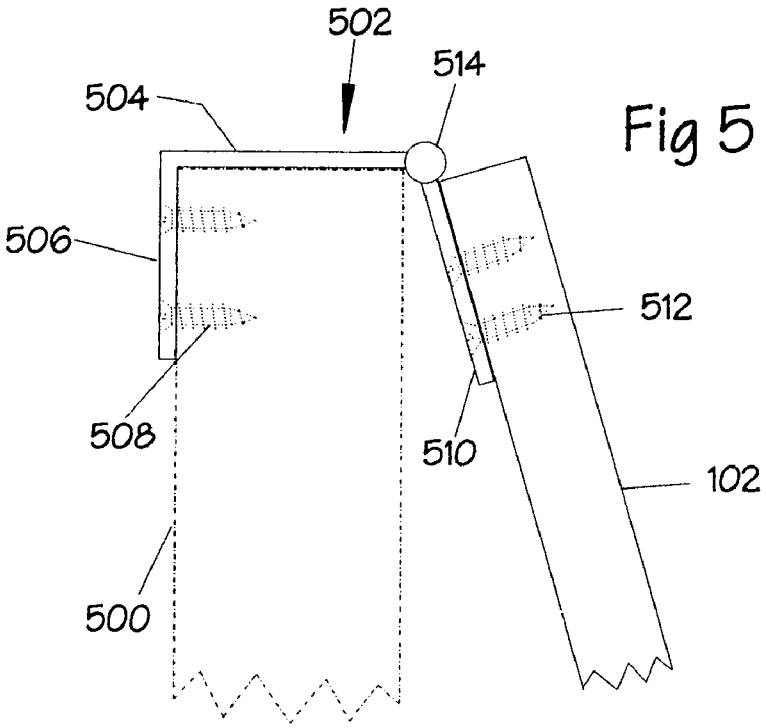
FIG. 5 is side elevation of the upper end of the invention showing the details of a door-mountable upper hinge.

Such a door-mountable hinge 502, is shown in FIG. 5, in which door 500 serves as the vertical support. Hinge top plate 504 rests on the upper surface of the door's upper edge. Hinge back plate 506 depends substantially perpendicularly from a first end of the hinge top plate, and extends down the inner or outer surface of the door. The door-mountable hinge is attached to the door by means of screws 508 or other attachment means. Pivot means 514 pivotally connects swing plate 510 to a second end of hinge top plate 504. Swing-arm 102 is attached to hinge swing plate 510 by screws 512 or other attachment means.

Anti-Friction Means on the Free Terminus of the Drop-Arm.

As our invention is being converted from the folded configuration (FIG. 1) to the deployed configuration (FIG. 2) and back again, it is possible for the free terminus 110*a* of the drop-arm 110 to scratch or mar the vertical support 100 as the free end of the drop-arm falls into place and is pulled upward again. To mitigate damage to the vertical surface, the free end may be optionally covered with a low-friction material to cushion the edge of the drop-arm. A hard rubber or plastic material such as Teflon® is suitable for such a covering.

Figure 6:
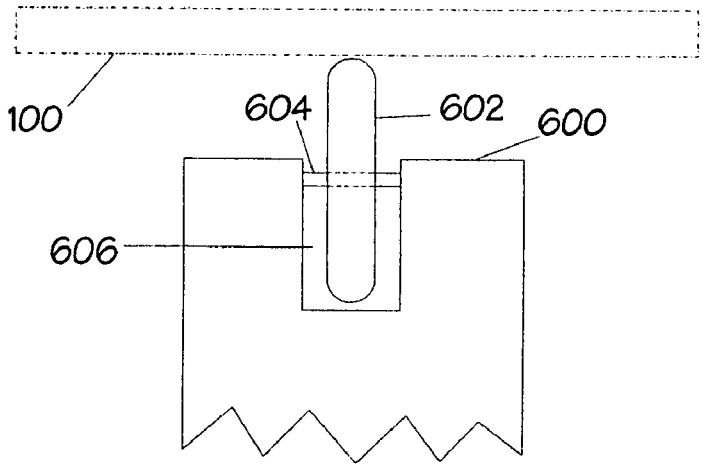
FIG. 6 is a front view of the free terminus of the drop-arm modified to accept a wheel.

Alternatively, the free end of the drop-arm can be optionally fitted with a rotating device, such as a wheel or roller, as disclosed in FIG. 6, which shows a modified free terminus 600 of a drop-arm. The modification comprises the addition of an axle 604 and a wheel 602 mounted in a notch or recess 606 for receiving the axle and wheel. Such a wheel adaptation allows the free terminus of the drop-arm for fall to its extended position and to be raised to its folded position without marking or marring the vertical support 100.

Non-Horizontal Orientation of the Drop-Arm.

In our preferred embodiment drop-arm 110 is substantially horizontal when the invention is in the deployed configuration, as shown in FIG. 2. This is achieved by choosing the length of cord 106, the length of drop arm 110, and the point of attachment of the drop arm to the swing-arm 102 such that angle $\alpha$ will be approximately 90° when the cord is fully extended. A horizontal orientation of the drop arm is advantageous because the lower end of the swing-arm is at the greatest distance from the vertical support when the drop-arm is horizontal. However, it is to be noted that a perfectly horizontal orientation of the drop-arm is not critical to the proper functioning of the invention.

For instance, if the drop-arm is modified to accommodate a wheel or roller as disclosed above, it is desirable for angle $\alpha$ is to be somewhat greater than 90° so that the free terminus 110*a* of the drop-arm is lower than the fixed terminus 110*b*. Such a non-horizontal orientation of the drop-arm counteracts a tendency of the wheel to ride up the vertical surface under the forces imposed by the swing-arm and the articles hanging thereon.

Weighted Keeper.

In our preferred embodiment the keeper means, shown as stop 108, is weighted to act as a counterweight to the drop-arm. This is done by either by constructing the keeper from a dense material or by adding lead, steel, or other sufficiently dense material to the keeper. The primary advantage of such a weighted keeper is that it prevents the free end 110*a* of the drop-arm from falling too quickly and forcefully when converting the rack from the folded to the deployed configuration. This helps prevent damage to the vertical support.

SUMMARY

From the foregoing description the novelty, utility, means of constructing, and means of using our invention will be readily understood; however, the foregoing description merely represents the best mode known to us as of the present date. The embodiment herein disclosed is not meant to be exclusive of other ways of making and using our invention, and it will be obvious to those of average skill in the field that other means of producing and/or using our invention lie within the scope of this disclosure and the claims, below. Consequently, it is to be understood that our invention is not limited to the embodiment disclosed above but encompasses any and all embodiments within the scope of the following claims.

We claim:

1. A swing-arm rack that is reversibly convertible between a folded configuration and a deployed configuration, the swing-arm rack comprising:

a) an elongate swing-arm having i) an upper terminus delimiting an upper end of the swing-arm, ii) a lower terminus delimiting a lower end of the swing-arm, iii) an inward surface facing a vertical support, iv) an outward surface facing away from the vertical support, and v) an aperture through the swing-arm from the inward surface to the outward surface;

b) an upper hinge means for pivotally connecting the upper terminus of the swing-arm to the vertical support;

c) a drop-arm having i) a fixed terminus delimiting a fixed end of the drop-arm, and ii) a free terminus delimiting a free end of the drop-arm;

d) a lower hinge means for pivotally connecting the fixed terminus of the drop-arm to the swing-arm inward surface;

e) a keeper;

f) a flexible restraint having a first end and a second end, the first end of the flexible restraint being connected to the free end of the drop-arm, and the second end of the flexible restraint passing through the aperture from the inward surface of the swing-arm to the outward surface of the swing-arm and secured by the keeper against the outward surface of the swing-arm when the swing-arm rack is in the deployed configuration; and g) at least one lateral projection for holding hanging articles, the lateral projection extending laterally from the swing-arm, whereby when the swing-arm rack is in the deployed configuration, the flexible restraint holds the drop-arm with the free end of the drop-arm abutting the vertical support, thereby locking the lower end of the swing-arm away from the vertical support and transmitting to the vertical support the gravitational force acting upon the swing-arm and the hanging articles supported thereby; and whereby conversion from the deployed configuration to the folded configuration is achieved by using the flexible restraint to urge the free end of the drop-arm upwards into a substantially vertical orientation such that the drop-arm is positioned between the inward surface of the swing-arm and the vertical support and the free end of the drop-arm is juxtaposed against the upper end of the swing-arm, and the swing-arm hangs in a substantially vertical orientation supported by the upper hinge.

2. The swing-arm rack of claim 1 wherein the drop-arm is in a substantially horizontal orientation a when the swing-arm rack is in the deployed configuration.

3. The swing-arm rack of claim 1 wherein the upper hinge means is a door-mountable hinge means for attaching the swing-arm rack to the upper edge of a door, the door-mountable hinge means comprising:

a) a hinge top plate that is adapted to rest on the upper surface of the upper edge of the door, the hinge top plate having a first end and a second end;

b) a hinge back plate depending substantially perpendicularly from the first end of the hinge top plate;

c) a hinge swing plate for connecting the upper end of the swing-arm to the door-mountable hinge;

d) a pivot means for pivotally connecting the hinge top plate second end and the hinge swing plate;

e) means for securing the door-mountable hinge to the door; and f) means for securing the upper end of the swing-arm to the hinge swing plate.

4. The swing-arm rack of claim 1 wherein the lateral projections project from only one side of the swing-arm.

5. The swing-arm rack of claim 1 wherein the free terminus of the drop-arm comprises an anti-friction means for reducing for reducing friction between the free terminus of the drop-arm and the vertical support.

6. The swing-arm rack of claim 5 wherein the anti-friction means is a protective coating.

7. The swing-arm rack of claim 5 wherein the anti-friction means is a rotating device.

8. The swing-arm rack of claim 1 wherein the keeper is chosen from the group consisting of a stop, gland, cleat, and knot.

9. The swing-arm rack of claim 1 wherein the keeper is weighted.

* * * * *